United States Patent [19]

Bannan

[11] Patent Number: 4,982,471

[45] Date of Patent: Jan. 8, 1991

[54] MULTI-USE PAINT TOOL

[76] Inventor: John A. Bannan, 10 Don Mills Rd., Suite 423, Don Mills, Ontario M3B 3N9, Canada

[21] Appl. No.: 498,665

[22] Filed: Mar. 26, 1990

[51] Int. Cl.[5] ..... B44D 3/06

[52] U.S. Cl. ..... 15/105; 15/236.03; 15/236.05; 15/236.07; 206/15.3; 206/361; 220/90

[58] Field of Search ..... 15/105, 236.05, 236.07, 15/236.03; 220/90; 206/15.2, 15.3, 361, 362.3; 211/65, 66; 248/110

[56] References Cited

U.S. PATENT DOCUMENTS

| | | | |
|---|---|---|---|
| 2,389,756 | 11/1945 | Beech | 248/110 |
| 2,852,144 | 9/1958 | Reno | 211/65 |
| 2,860,858 | 11/1958 | Kurs | 15/236.03 X |
| 3,185,311 | 5/1965 | Roberts et al. | 211/66 |
| 3,275,187 | 9/1966 | Lamoureaux | 220/90 |
| 4,324,018 | 4/1982 | Olsson | 15/236.03 |
| 4,553,279 | 11/1985 | Gassew et al. | 15/105 X |
| 4,628,563 | 12/1986 | Kramer | 15/236.03 X |

*Primary Examiner*—Chris K. Moore

*Attorney, Agent, or Firm*—Blake, Cassels & Graydon

[57] ABSTRACT

This invention concerns accessories for use with painting tools. Such an accessory may comprise an elongate member having means to suspend a paint brush vertically into an open topped vessel, means to scrape excess paint out of a paint roller, and a means for cleaning out grooves around the rim of a paint can.

4 Claims, 4 Drawing Sheets

40
10
38
12
18
20
14
30
34
28
22
16
36
32
46
46
42
44

38
14
40
10
12
22
18
30
20
34
28
36
32
16
42
46
46
44

MULTI-USE PAINT TOOL

BACKGROUND OF THE INVENTION

1. Field of the Invention

This invention relates to accessories for use with tools for applying liquid coatings, for example, paint.

2. Background of the Invention

A problem exists in the decorating business relating to the general handling of tools. Such tools, especially paint brushes tend to be spoiled due to insufficient care by the operator. The case process may be onerous and, when it is necessary to clean brushes using solvent, it is important that the brushes not be left standing thereby risking damage to the bristles by permanent bending. It is especially true in the home decorating field that many paint brushes are spoiled beyond repair by leaving them standing in solvent. Although the problem is not so acute where water based paints are concerned, the problem still exists.

Additional problems arise with the use of paint rollers which, even when water based paints are used, are difficult to clean properly. Many rollers are discarded before it is strictly necessary because of the difficulties in cleaning them.

It would seem that interior decorating is fraught with dangers for the home decorator. Even the rim of the paint cans may be the source of additional paint spillage and mess. The rim of paint cans conventionally includes a groove which frequently becomes filled with wet paint due to the tendency of the operator to adjust the amount of paint on the brush by wiping the brush against the rim of the can. When the lid is replaced on the paint can after use, paint in this groove is displaced and may splash into the environment or run down the side of the can.

The present inventor has, therefore, attempted to design a simple inexpensive accessory which may alleviate some of the above mentioned problems.

SUMMARY OF THE INVENTION

The present invention provides an accessory for use with tools for applying liquid coatings comprising a rigid elongate member adapted as a manually movable cross-bar over a open topped vessel, the member comprising, a mid portion including holding means adapted to hold a brush to depend vertically from the cross-bar to dip into the paint brush container, one end portion having an arcuate portion adapted to scrape a portion of a cylindrical liquid coating applying roller, and the other end portion having a prong adapted to fit into and slid in a groove in the rim of a paint can.

Suitably, the elongate member may comprise a slat having substantially flat top and bottom surfaces. This slat may suitably be molded from rigid or semi-rigid plastics material. The holding means may suitably comprise a lateral slot into the slat. One end of the slot opens to one side of the slat and a blind end of the slot is located between the sides of the slat possibly somewhere near the middle. The open end of the slot should be chosen to have a width such that the handle of a paint brush may be slide laterally into the slot. Thus, the paint brush may have the handle in a vertical position with respect to the slot. Most paint brushes are made with a narrow portion of the handle at the lower end, the upper portion of the handle being somewhat elongate ellipsoid in shape so as to be comfortable to hold in the hand. Such a shape of handle is extremely convenient in that the narrow portion of the handle may be slid into the slot and, if the width of the slot is properly chosen the upper portion of the handle will be of sufficient thickness to prevent the upper portion of the handle slipping vertically, downwardly out of engagement with the slat.

Thus, it may be seen that the slat may be rested as a cross-bar across the open top of a vessel containing solvent for cleaning the brush. The paint brush is then inserted into the slot to be be suspended such that it dips into the vessel, but does not rest on the bottom thereof. The level of the liquid in the vessel will be chosen such that the bristles of the brush dip into the liquid, preferably at least to the top of the bristles.

In this connection, it is to be noted that many paint brushes nowadays have bristles or other paint applying surfaces made of many materials. In particular, it is intended that the term "paint brush", includes brushes having bristles, hairs, fur, sponge, foam, or other paint or liquid coating applying means. Moreover, the term "paint brush" is intended to include means for applying liquid coatings such as varnish, enamel, wood finishes, adhesive, stains, etc.

Some brushes or other applicators may not have a thickened portion at the upper end or it may desired to adjust the height of the brush in the slot. For the this purpose, clamp means may be provided located to clamp the brush handle in the slot to adjust its position and to hold it firmly against wobbling. Clamping may also provide insurance for dislocation from the slot, if the arrangement is inadvertantly jolted. The clamp may comprise a slide adjustably slidable in a groove of the slat to project into the blind end to bear against the brush handle therein. In this case, means are provided to secure the slide against sliding once the desired position of the slide has been achieved.

The arcuate portion at one end of the slat is suitably conformed to correspond with the arc of a conventional sized paint application roller. It should be noted that the term "paint application roller" is intended to cover rollers for the application of other liquid coatings generally and similar terms as discussed above in connection with paint brushes. The arcuate portion at the end of the slat is intended to act as a scraper for the paint roller so that excess liquid coating may be squeezed or scraped from the roller. Suitably, the arcuate portion may be bevelled between the upper and lower surfaces of the slat to form a scraper blade.

At the other end of the slat, the prong for fitting into and sliding in the groove in the rim of the paint can is intended for &he purpose of cleaning surplus paint from this groove prior to the closing of the paint can after use. Thus, the prong may suitably be conformed to the shape of the groove which conventionally has a narrow bottom surface and two sloping side surfaces.

BRIEF DESCRIPTION OF THE DRAWINGS

An embodiment of the invention will now be described by way of example with reference to the drawing in which.

DETAILED DESCRIPTION OF PREFERRED EMBODIMENTS

A painting accessory 10 comprises a mid-portion 12, an end portion 14, and another end portion 16.

Figure 1:
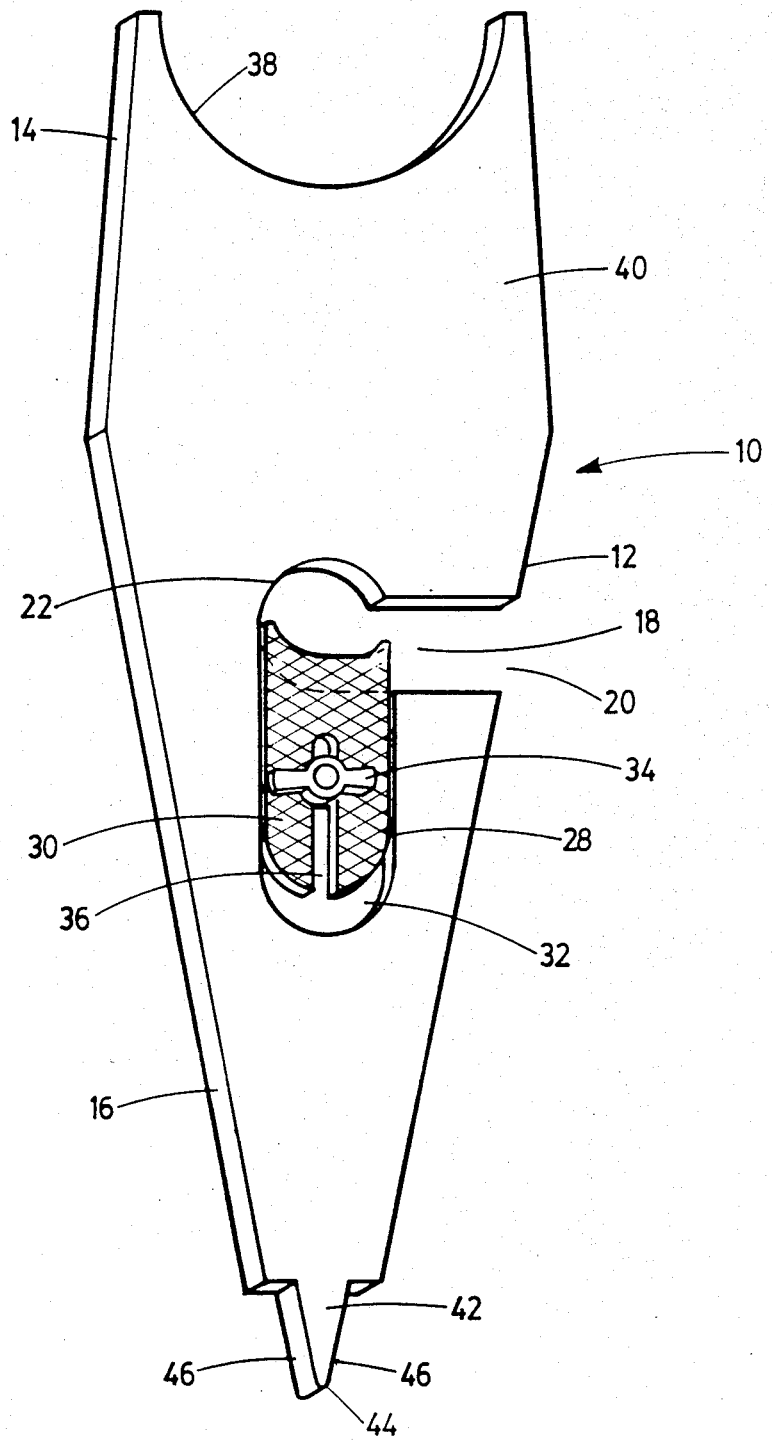
FIG. 1 illustrates the use of the tool as a brush holder for suspending a brush in a liquid.
Figure 2:
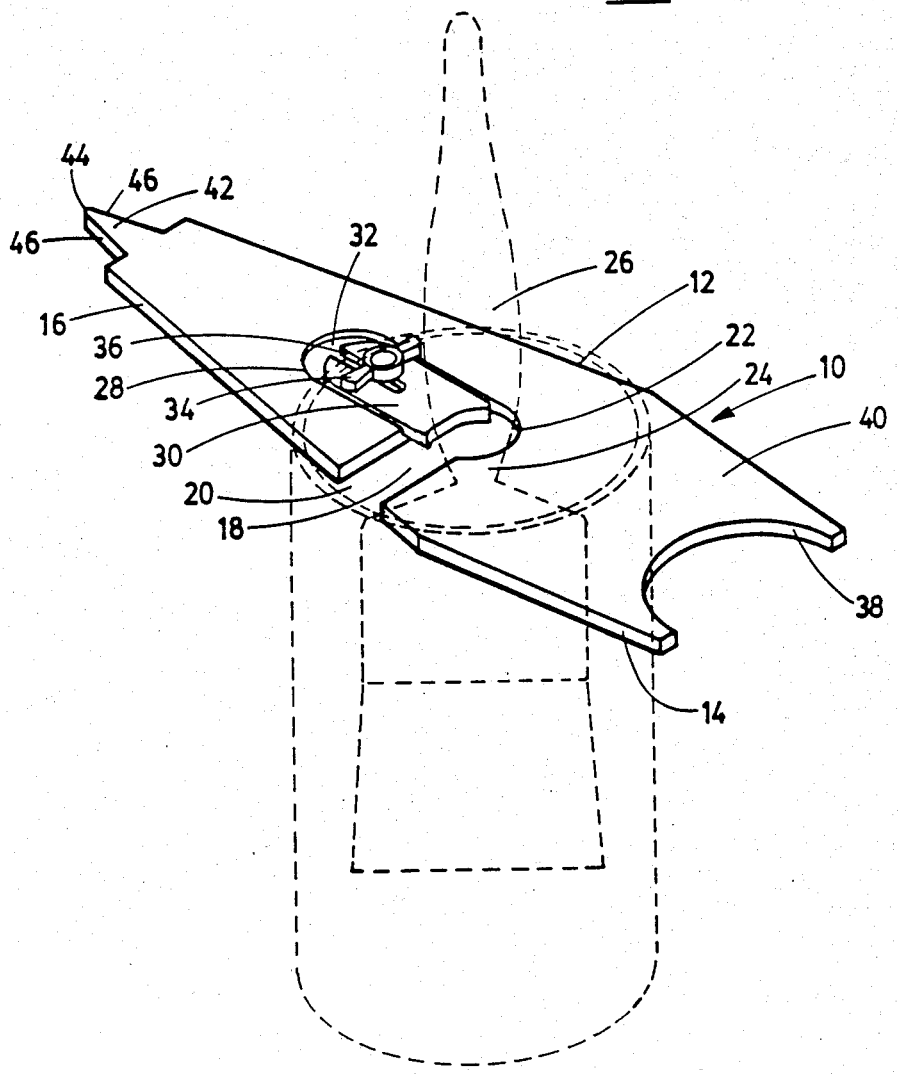
FIG. 2 illustrates the use of the tool in scraping a paint roller.
Figure 3:
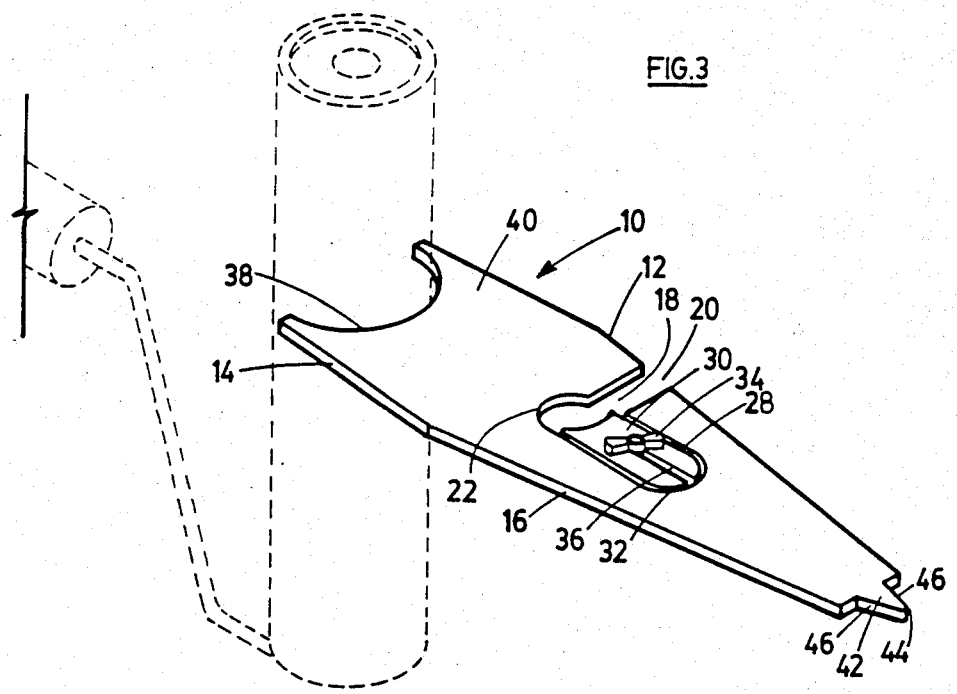
FIG. 3 illustrates the use of the tool in cleaning a groove of the rim of a paint can.
Figure 4:
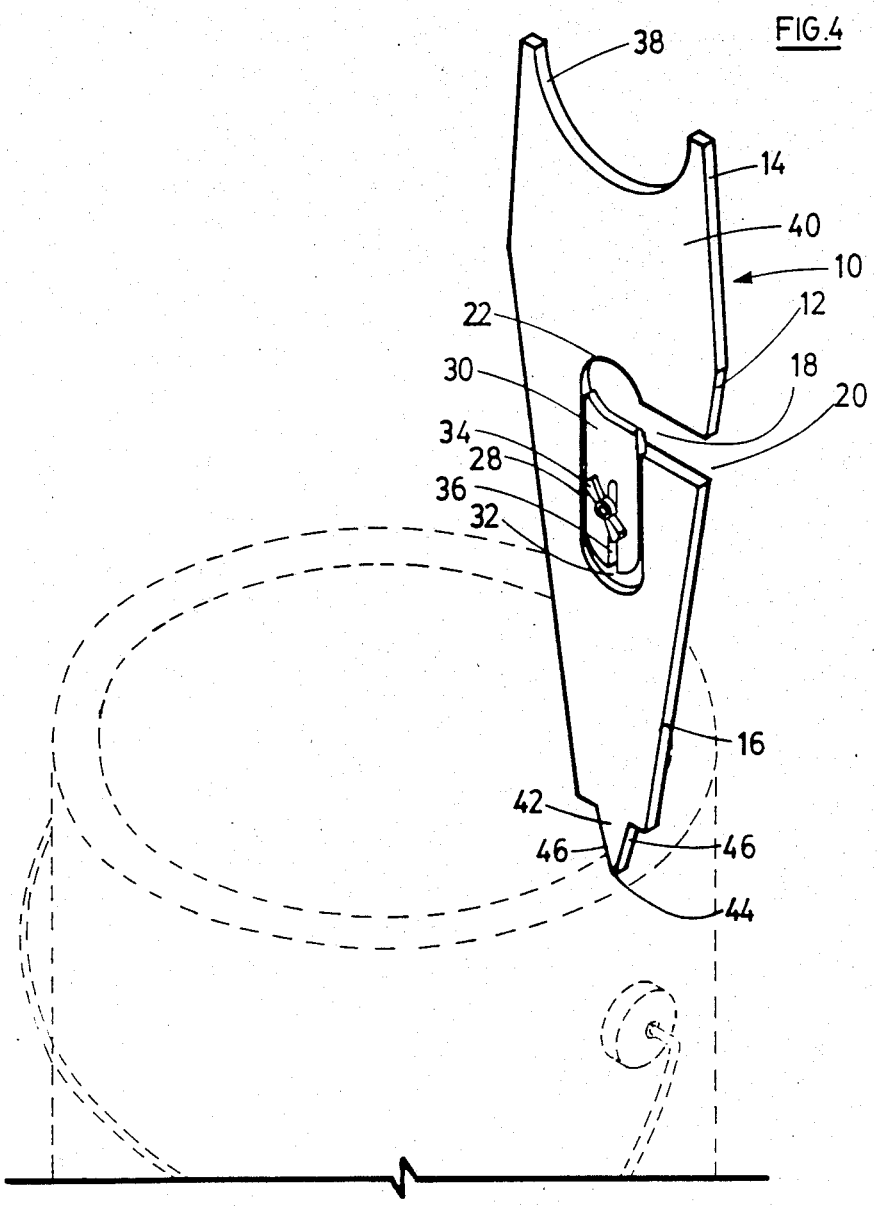

The mid-portion 12 is provided with a keyhole slot 18 having an open end 20 and a blind end 22, the blind end being of generally circular configuration. The width of the slot is such as to allow the vertical brush handle 24 to pass into the slot. Most brush handles are thicker at the top than at the bottom and, as can be seen from FIG. 1, it is not necessary to clamp the brush handle in any way since the thicker portion of the handle 26 is two thick to pass through the blind end 22 of the slot 18. Nevertheless, since all brush handles are not made to this specification and, it may desirable to adjust the height of the brush handle within the slot, a clamp 28 is provided. The clamp 28 comprises a slide bar 30 sliding in a groove 32 of the slat. The clamp operates by loosing wing nut 34 so that the slide bar may slide freely in slot 32 with the bolt of wing nut 34 sliding in slot 36 of slide bar 30. When the desired clamping position is reached wing nut 34 is tightened to hold slide bar 30 securely in groove 32.

At one end 14 of the accessory 10, an arcuate portion 38 is provided for scraping a paint roller. Suitably, the arcuate portion may be bevelled from the top surface of the slat 40 to the lower surface or vice-versa. Such bevelling forms a shape edge to the arcuate portion to act as scraper blade. Suitably, the arcuate portion is conformed to the contour of a conventional paint applicator roller. Different sizes of accessory 10 may be provided for different brushes or rollers, but generally, if the dimensions of the accessory are chosen to suit medium dimensions of the tools, then a single accessory will be found suitable for most paint brushes or rollers.

At the other end 16 of the accessory 10, a spike or prong 42 is provided for cleaning the groove at the rim of a paint can. This spike should generally conform to the shape of the groove, that is, it should have a narrow or pointed end 44 and should widen through symmetrical sloping sides 46. Provided that the shape of this prong or spike 42 allows it to be fitted into the groove of the rim of the paint can, its precise shape is not of prime importance.

I claim:

1. An accessory for use with tools for applying liquid coatings comprising a rigid elongate member adapted as a manually movable cross-bar over an open topped vessel, the member comprising;

a slat having substantially flat top and bottom surfaces including;

a mid portion including holding means adapted to hold a brush to depend vertically from the elongate member to dip into the paint brush vessel when the member rests as a cross-bar over the mouth of the vessel, the holding means comprising a slot through the slat having one end opening to one side of the slat and a blind end located between the sides of the slat, the open end of the slot being of a width to allow access of a handle of a brush laterally thereinto;

one end portion having an arcuate portion adapted to scrape a portion of a cylindrical liquid coating applying roller; and the other end portion having a prong adapted to fit into and slide in a groove in the rim of a paint can.

2. An accessory for use with tools for applying liquid coatings as claimed in claim 1, in which a clamp is located to clamp the brush handle at the blind end of the slot.

3. An accessory for use with tools for applying liquid coatings as claimed in claim 2, in which the clamp comprises a slide adjustably slidable in a groove of the slat to project into the blind end to bear against a brush handle therein, means being provided to secure the slide against sliding.

4. An accessory for use with tools for applying liquid coatings as claimed in claim 1, in which the arcuate portion is bevelled between upper and lower surfaces.

* * * * *